United States Patent [19]

Kanno

[11] 4,095,792

[45] Jun. 20, 1978

[54] GAME STRUCTURE

[75] Inventor: Hideyuki Kanno, Tokyo, Japan

[73] Assignee: Tomy Kogyo Co., Inc., Tokyo, Japan

[21] Appl. No.: 733,392

[22] Filed: Oct. 18, 1976

[30] Foreign Application Priority Data

Oct. 27, 1975 Japan ..... 50-129558[U]

[51] Int. Cl.[2] ..... A63F 9/00

[52] U.S. Cl. ..... 273/85 R

[58] Field of Search ..... 273/85 R, 85 C, 85 D, 273/85 F

[56] References Cited

U.S. PATENT DOCUMENTS

| | | | |
|---|---|---|---|
| 4,006,897 | 2/1977 | Llorens | 273/85 R |
| 4,006,899 | 2/1977 | Lohr et al. | 273/85 R |

*Primary Examiner*—Anton O. Oechsle

*Attorney, Agent, or Firm*—Edward D. O'Brian

[57] ABSTRACT

A game structure capable of being used to simulate to a degree any of a series of games such as basketball, volleyball or the like can be constructed so as to utilize a housing having a transluscent or transparent front surface. In a game structure as disclosed a carriage is mounted in the housing in back of the front surface so as to be capable of being moved back and forth along a path. A member simulating a member which is moved as a game is played is supported on the carriage so as to be moved as the carriage is moved. This member is of such a character as to be capable of being viewed through the front surface of the housing. Two separate structures are provided for moving the carriage. One of these is mounted adjacent to one end of the housing and the other is mounted adjacent to the other end of the housing. Each of these structures for moving the carriage is capable of being actuated so as to exert repetitive blows against the carriage as it is repetitively actuated in order to cause the carriage to move.

7 Claims, 8 Drawing Figures

GAME STRUCTURE

BACKGROUND OF THE INVENTION

The invention set forth in this specification pertains to new and improved game structures. The embodiment of the invention specifically disclosed in this specification pertains to a game structure which simulates to a degree the game of basketball. It is considered, however, that the principles of the invention can be utilized to provide a series of different game structures which simulate to various extents any of a series of games in which a member such as a ball, a shuttlecock or the like is moved or propelled from one extremity of a playing area to another.

It will, of course, be recognized that an untold number of different game structures capable of being utilized to simulate games as are noted in the preceding have been developed and utilized in the past. Within a comparatively recent time period a number of different electronic games have been developed which are based upon the movement of a dot of light simulating a ball or other member being propelled back and forth across the viewing surface of a cathode ray tube. Such games are normally played by one or more players adjusting a member with respect to the moving dot of light so as to intercept and cause the dot of light to move back and forth along the playing surface.

Games of the latter category have extensively caught the imagination of the public. They are considered to be highly effective as game structures. It is also considered that such game structures are, because of their electronic character, sufficiently high priced so that they cannot be widely utilized and accepted, particularly by children. Many children know of such electronic games and desire to utilize them.

BRIEF SUMMARY OF THE INVENTION

As a result of the latter it is considered that there is a need for new and improved game structures which effectively simulate electronic games as are indicated in the preceding discussion, but which are of such a character that they are much less expensive than such electronic games. A broad objective of the present invention is to fulfill this need. Related objectives of this invention are to provide game structures which simulate electronic games in which a dot of light moves back and forth across the surface of a cathode ray tube which are comparatively simple to construct, which are comparatively inexpensive, which are essentially mechanical in character, which are capable of prolonged use by children without mechanical breakdown, and which are very effective for play purposes in holding the attention of children.

In accordance with this invention these various objectives are achieved by providing a game structure which comprises: a housing having a bottom, a translucent or transparent front surface, and ends connected by the bottom and the front surface, a carriage movably mounted on the bottom so as to be capable of being moved back and forth along a path in back of the front surface, visible means for simulating a member which is moved as the game is played supported on the carriage so as to be moved as the carriage is moved, this visible means being capable of being viewed through the front surface, and at least one moving means for moving the carriage, the moving means being capable of being actuated so as to exert repetitive blows against the carriage in order to move the carriage.

BRIEF DESCRIPTION OF THE DRAWINGS

A game structure of the present invention is preferably somewhat more complex than indicated in the preceding summary so as to be capable of effectively simulating a known game in which a member is moved back and forth as the game is played such as basketball. Because of this it is considered that the invention is best more fully described with reference to the accompanying drawings in which.

Figure 1:
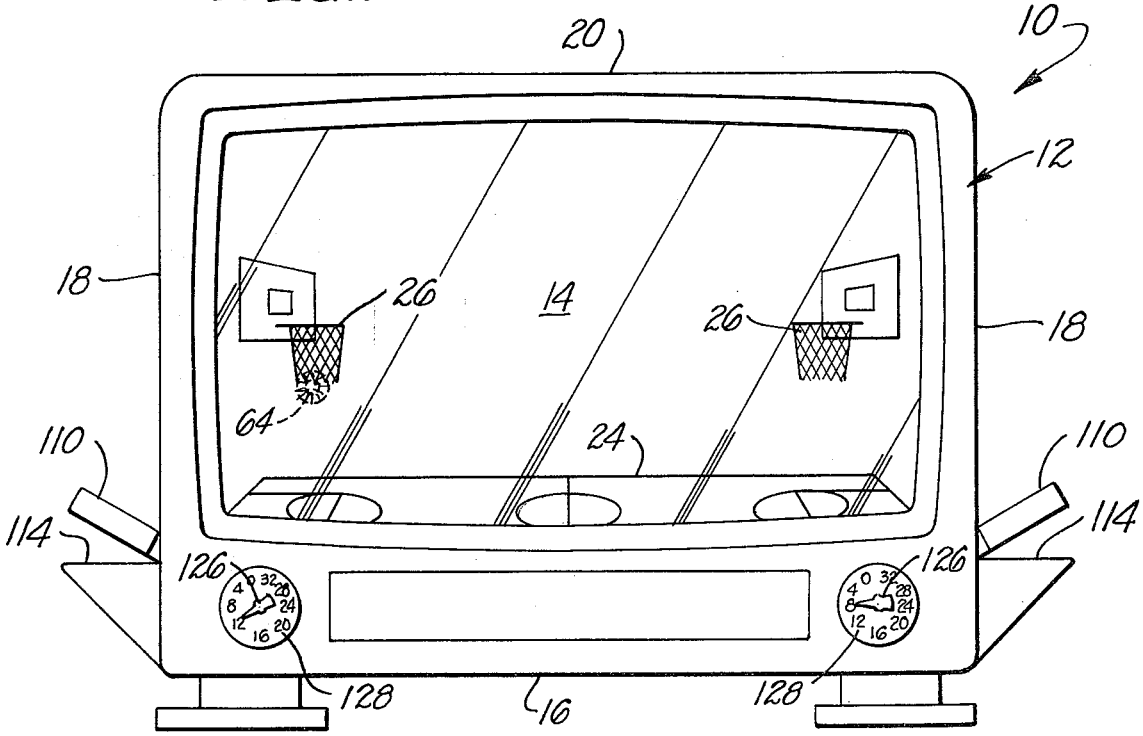
FIG. 1 is a front elevational view of a presently preferred embodiment or form of a game structure of the present invention constructed so as to simulate the game of basketball.
Figure 2:
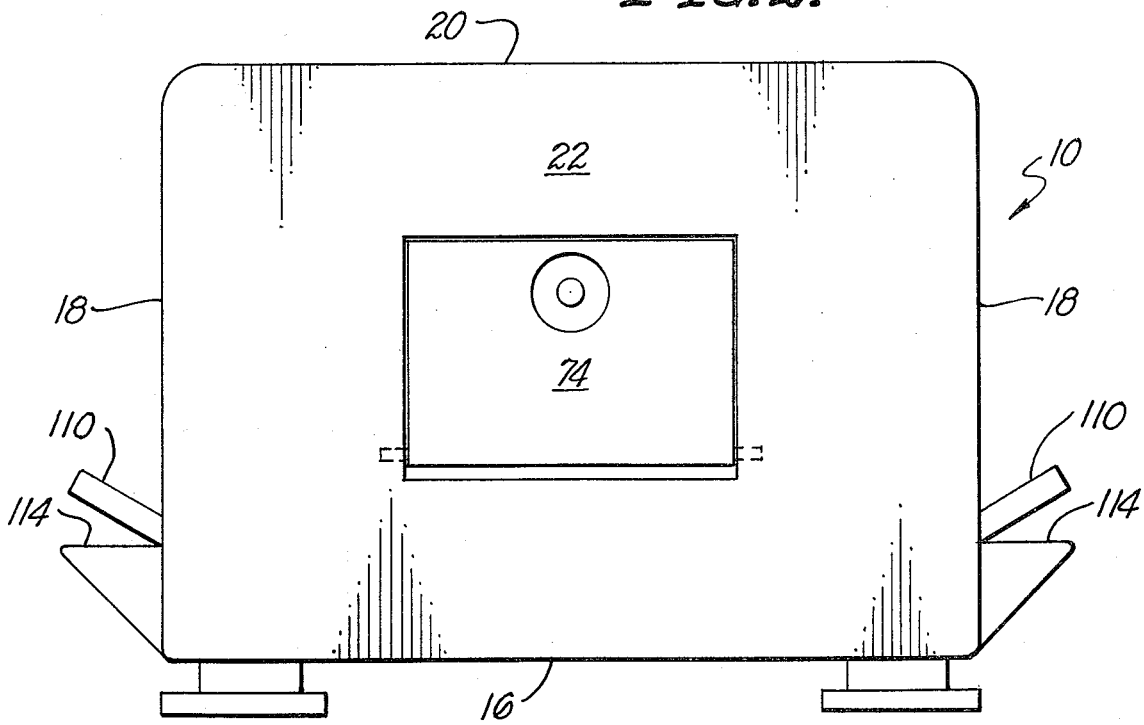
FIG. 2 is a rear elevational view of this game structure.

The particular game structure illustrated embodies certain operative concepts or principles as are set forth in the various claims at the end of this specification. Those familiar with the design and construction of mechanical toys will realize that these concepts or principles can be easily embodied within a wide variety of differently constructed and differently appearing game structures through the use or exercise of routine skill in the field of the design and construction of mechanical toys.

DETAILED DESCRIPTION

The toy game structure 10 of the invention illustrated includes a housing 12 formed so as to include a translucent or transparent front surface 14, a bottom or base 16, opposed ends 18 connected by the surface 14 and the bottom 16, a top 20 and a removable back cover 22 serving to enclose various operative parts as hereinafter indicated. Indicia 24 simulating a basketball court and further indicia 26 simulating the baskets used with such a court are provided on the front surface 14.

A support platform 28 forming part of the bottom or base 16 is located within the housing 12 intermediate the ends 18. This platform 28 includes an elongated slot 30 extending parallel to the front surface 14. Rubber bumpers 32 are mounted on the platform 28 in alignment with the slot 30 and spaced from the ends 34 of the slot 30. This platform 28 is used to support a carriage 36 having wheels 38 which rest upon the platform 28. A small guide member 40 extends downwardly from the carriage 36 through the slot 30 for the purpose of insuring that the carriage 36 will only move in a linear path parallel to the front surface 14.

Preferably an enlarged head 42 is provided on the guide 40 for the purpose of preventing movement of the carriage 36 generally away from the platform 28. With this structure the bumpers 32 limit the movement of the carriage 36 toward the ends 18 of the housing 12. These bumpers 32 are preferably formed of an elastomeric material such as a rubber composition so as to absorb any shock resulting from the carriage 36 hitting against them so as to minimize vibration.

The carriage 36 is provided with parallel, upstanding, spaced supports 44. Each of these supports 44 is provided with an upwardly directed groove serving as a bearing opening 46. If desired one of these supports 44 may include a small, pivotally mounted shaft retainer 48 which frictionally bears against the support 44 upon which it is located. These bearing openings 46 support a shaft 50 extending from both sides of a light unit 52. The retainer 48 is adapted to be utilized to hold the shaft 50 so as to prevent the light unit 52 from moving away from the carriage 36.

This light unit 52 includes a bottom section 54 serving as a housing holding batteries 56. This bottom section 54 preferably also includes a small counter weight 58 tending to balance the entire light unit 52 so that it may be pivotted between positions in which an arm 60 extending from the bottom section 54 is directed generally toward either of the ends 18. The arm 60 carries a small housing 62 carrying a light bulb (and socket) 64 remote from the shaft 50. An opening 66 in the housing 62 is used to convey light from the bulb 64 to immediately in back of the front surface 14 so that the light from the bulb 64 will be visible through this front surface 14.

Preferably this front surface 14 will be transluscent so that the light from the bulb 64 will be visible through the front surface 14 while various other operative parts within the housing 12 are concealed from view. It is, however, possible to form an effective game structure 10 in which the front surface 14 is transparent. The important factor is to make the game structure 10 in such a manner that this light bulb 64 or any other equivalent element substituted for it such as a colored disk (not shown) is visible through the front surface 14 as the game structure 10 is used.

Figures 4, 5, 6, 7, 8:
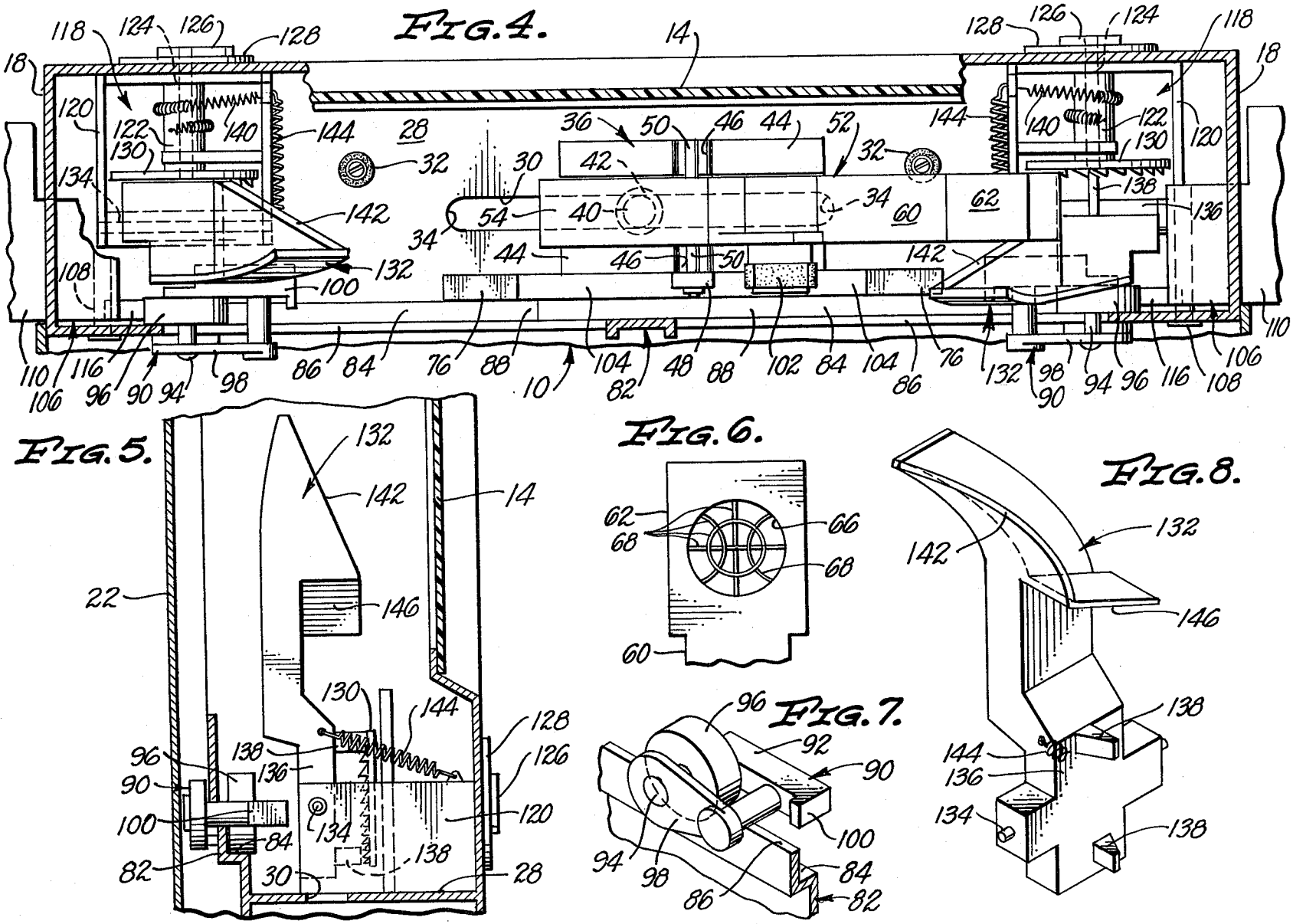
FIG. 4 is a cross sectional view taken at line 4—4 of FIG. 3.
FIG. 5 is a partial cross sectional view taken at line 5—5 of FIG. 3.
FIG. 6 is a front elevational view of part of an arm employed in the structure illustrated in the preceding figures showing a light source employed as a visible means simulating a basketball.
FIG. 7 is a partial isometric view indicating the principal parts of a striker structure or moving means employed in the game illustrated in the preceding figures for moving a carriage.
FIG. 8 is an isometric view of an actuator serving as an escapement lever in a counting structure or counting means employed in the game structure illustrated.

This opening 66 is preferably formed as indicated in FIG. 6 so as to have various internal ribs 68 effectively simulating the stitching on a common ball such as a basketball. The light unit 52 also includes various conventional conductors 70 and a conventional switch 72 mounted on the bottom section 54 and on the arm 60 for the purpose of controlling the operation of the bulb 64. A small door 74 of conventional design may be provided on the back cover 22 for the purpose of facilitating access to the switch 72.

The carriage 36 also includes two separate levers 76 each of which is pivotally mounted on the carriage 36 through the use of conventional fasteners 78 serving as pivots. Lugs 80 on the carriage 36 limit the downward movement of these levers 76 and the retainer 48 limits the upward movement of the levers 76 in such a manner that these levers 76 will always tend to fall back against the lugs 80 after they have been engaged. These levers 76 are located adjacent to a plate 82 which is mounted within the housing 12 parallel to the front surface 14 immediately above the bottom 16 within the back cover 22.

This plate 82 is formed so as to include two identical ramps 84 located adjacent to slots 86 which extend parallel to these ramps 84. Each of the ramps 84 leads upwardly at an angle from adjacent to an end 18. Each of the ramps 84 terminates at a stop 88 formed in the plate 82. These ramps 84 are adapted to carry what are referred to herein as strikers 90. These strikers 90 are mirror images of one another. Each of these strikers 90 includes a body portion 92 carrying a shaft 94 mounting a comparatively heavy roller 96. It will be noted that these body portions 92 include enlarged sides 98 which effectively straddle the ramps 84 so as to serve to guide the strikers 90 so that they will only move in a linear manner along the ramps 84.

Figure 3:
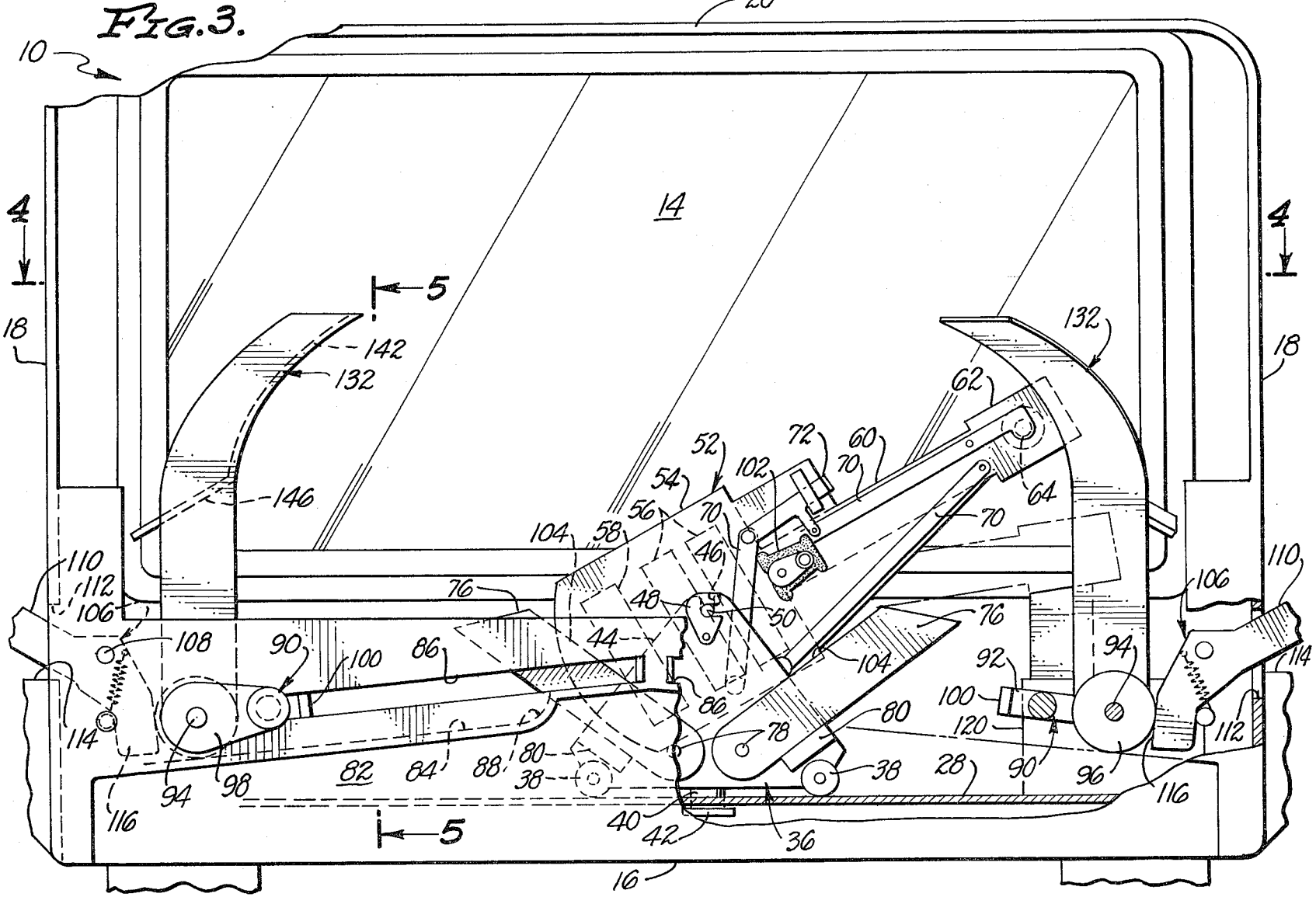
FIG. 3 is a rear elevational view with the rear cover of the game removed, this view being partially broken away so as to facilitate an understanding of the invention.

The rollers 96 employed are sufficiently heavy so as to be capable of returning the strikers 90 through the action of gravity toward positions as shown in FIG. 3 in which these strikers 90 are at the lowermost portions (not separately numbered) of the ramp 84 adjacent to the end 18. Each of the body portions 92 includes a hammer-like end 100 which is adapted to engage one of the levers 76 in order to impart motion to the carriage 36. It will be realized that when a lever 76 is engaged by a hammer-like end 100 of a striker 90 that this lever 76 will be rotated slightly in an amount depending upon the degree of the impact by the hammer-like end 100. The initial rotation of a lever 76 will not normally result in movement of the carriage 36. If the force applied by a hammer-like end 100 is great enough a lever 76 will be moved into engagement with the shaft retainer 48 and this in turn will cause movement of the carriage 36.

An important feature of the present invention which is considered to aid in the game structure 10 effectively simulating the game of basketball relates to the fact that the light unit 52 includes a shock absorbing rubber projection 102 which extends outwardly from the remainder of this unit 52 to a sufficient extent so as to be capable of engaging a sloping surface 104 on either of the levers 76 when the light unit 52 is in either of the two substantially horizontal positions that this unit 52 can assume. With this type of structure when the projection 102 is at rest against a sloping surface 104 of a lever 76 and when this lever 76 is engaged by the hammer-like end 100 of the striker 90 the movement of the lever 76 which is so engaged by the striker 90 will result in pivotting of the light unit 52 relative to the carriage 36. Thus, this rotation of the light unit 52 is in a sense independent of the movement of the carriage 36 although the light unit 52 is supported on the carriage 36 so as to be capable of being moved as the carriage 36 is moved.

Bell crank type levers 106 which are mirror images of one another are mounted upon shafts 108 so that arms 110 of these levers 106 project outwardly through openings 112 in the ends 18. These arms 110 are preferably shaped much as handles so that they may be manually engaged so as to be rotated against stops 114 located on the ends 18. During such rotation internal arms 116 on these levers 106 will hit against the strikers 90 when such strikers 90 happen to be at or adjacent to the end (not separately numbered) of a ramp 84 adjacent to an end 18. The impact of an arm 116 with a striker 90 is intended to propel such a striker 90 so as to impart movement to the carriage 36 and the light unit 52 in the manner described in the preceding. Because of their function the striker 90, the ramp 84 and the lever 106 may be collectively referred to as a moving means.

Such movement as is caused by appropriate actuation of the levers 106 so that repetitive blows are delivered to the strikers 90 through the actuation of the levers 106 will cause the carriage 36 to move back and forth along a linear path parallel to the front surface 14. Concurrently the light unit 52 will pivot back and forth relative to the carriage 36 and the front surface 14. As this occurs the light emitted from the bulb 64 will on occasion pass adjacent to the areas (not separately numbered) on the front surface 14 containing indicia 26 simulating baskets. This will, of course, correspond to "baskets" being made in a conventional game of basketball.

In order to improve playability of the game structure 10 it is considered desirable to incorporate within this game structure 10 two counters 118 which will count the number of "baskets" made during the use of the game structure 10. Each of these counters 118 includes an assembly (not separately numbered) of a framework 120 carrying a rotatable drum 122 located about a shaft 124. The shafts 124 are mounted on the frameworks 120 so as to extend to the front surface 14 adjacent to the bottom 16. There small hands 126 are located on the shafts 124 so as to point to dials 128 containing numbers. The shafts 124 are also secured to conventional crown ratchet wheels 130 which are intended to be utilized in controlling the rotation of the shafts 124 and the drums 122.

Elongated actuators 132 are pivotally mounted by pins 134 on the frameworks 120 so that the lowermost ends 136 of these actuators 132 are adjacent to the ratchet wheels 130. Conventional escapement teeth 138 are provided on the actuators 132 so as to coact with the ratchet wheels 130 in order to permit a limited amount of rotation of each shaft 124 each time a corresponding actuator 132 is deflected so as to bring its end 136 generally toward a ratchet wheel 130.

Small coil springs 140 extending between the drums 122 and the framework 120 will normally tend to bias the ratchet wheels 130 so that they are held against rotation by escapement teeth 138 and so that during each movement of an end 136 toward the ratchet wheel 130 there will be restricted motion of a shaft 124. The springs 140 can, of course, be placed under tension by rotating the hands 126 so as to reset the counters 118. The teeth (not separately numbered) of the ratchet wheels 130 slide against the escapement teeth 138 in order to permit such resetting of the counters 118.

Each of the actuators 132 is supplied with a tapered surface 142 which is adapted to be engaged by the arm 60 as the light unit 52 is moved and rotated so as to pass adjacent to the basket indicia 26. Such engagement of its tapered surface 142 will cause an actuator 132 to be pivotted in order to permit the end 136 to be moved so that the escapement teeth 138 coact with the ratchet wheel 130 in order to permit limited movement of a hand 126 and a counter 118. Small coil springs 144 are normally connected between the actuators 132 and the framework 120 for the purpose of biasing these actuators 132 in positions in which the escapement teeth 138 prevent rotation of the ratchet wheels 130 and in positions in which the surfaces 142 are located so that they can be engaged by the arm 60. If desired, however, these springs 144 may be dispensed with when the actuators 132 are balanced so as to automatically pivot back to a "normal" position through the action of gravity.

The actuators 132 also include stop walls 146 located at the lowermost extremities of the tapered surfaces 142. These stop walls 146 are designed to prevent the resilience of the projection 102 from causing the light unit 52 to bounce back away from a substantially horizontal position after a "basket" has been made as indicated by the light unit 52 passing relative to an indicia 26 as indicated. The action of a spring 144 will automatically return an actuator 132 to a position in which the light unit 52 cannot be pivotted relative to the carriage 36 until such time as one of the strikers 90 moves so as to cause movement of the carriage 36 to a sufficient extent so that a stop wall 146 will no longer preclude rotation of the light unit 52 relative to the carriage 36.

It is believed that it will be apparent from the preceding that the game structure 10 is of such a character that it can be manufactured without significant difficulty at a comparatively nominal cost. This game structure 10 is of a comparatively simple mechanical character which contributes to the game structure 10 being capable of prolonged use by children without mechanical malfunction. There are obviously a number of ways that the particular game structure 10 can be modified. The particular game structure 10 is primarily designed or intended for use by two children. It is considered that an effective toy or game may be manufactured utilizing the principles of this invention so that only one of the moving means for moving the carriage 36 are employed. Such a modified unit would substantially correspond to an individual shooting baskets by himself or herself.

I claim:

1. A game structure which comprises:

a housing having a bottom, a front surface through which an object can be viewed, and ends connected by said bottom and said front surface, a carriage movably mounted on said bottom so as to be capable of being moved back and forth along a path in back of said front surface between a first position adjacent to one of said ends and a second position adjacent to the other of said ends, an arm pivotally mounted on said carriage so as to extend therefrom and so as to be capable of being rotated parallel to said front surface, visible means for simulating a member which is moved as a game is played, said visible means being located on said carriage remote from said carriage so as to move as said carriage is moved, said visible means being capable of being viewed through said front surface, and two separate moving means for moving said carriage, one of said means being mounted adjacent to one end of said housing and the other of said means being mounted adjacent to the other end of said housing, each of said moving means being capable of being actuated so as to exert a blow against a part of said carriage so as to cause said carriage to move.

2. A game structure as claimed in claim 1 wherein:

the amount said arm can be pivotted on said carriage is limited by engagement with said carriage, said arm is capable of being pivotted between a position in which it is directed generally toward one end of said housing and a position in which it is directed generally toward the other end of said housing.

3. A game structure as claimed in claim 2 including:

two separate lever means pivotally mounted on said carriage in positions in which one of said lever means can be engaged by one of said moving means and the other of said lever means can be engaged by the other of said moving means, each of said lever means being capable of being engaged by one of said moving means in order to impart movement to said carriage, and in order to move said arm when said arm is adjacent thereto so as to impart movement to said arm.

4. A game structure as claimed in claim 1 including:

two separate lever means pivotally mounted on said carriage in positions in which one of said lever means can be engaged by one of said moving means and the other of said lever means can be engaged by the other of said moving means, each of said lever means being capable of being engaged by one of said moving means in order to impart movement to said carriage, and in order to move said arm when said arm is adjacent thereto so as to impart movement to said arm, two separate counting means for scoring the number of times that said visible means passes past a predetermined location in said front surface, one of said counting means being mounted on said housing adjacent to one of said ends, the other of said counting means being mounted on said housing adjacent to the other of said ends, and wherein the amount said arm can be pivoted on said carriage is limited by engagement with said carriage, said arm is capable of being pivoted between a position in which it is directed generally toward one end of said housing and a position in which it is directed generally toward the other end of said housing, each of said counting means including an actuator extending outwardly therefrom, said actuators being capable of being engaged and moved when said visible means is moved in back of a predetermined location on said front surface so as to actuate the counting means of which they form a part, each of said moving means includes a lever, an associated ramp and an associated striker, said levers being mounted on said housing so as to be accessible from the exterior of said housing, said ramps being located in back of said front surface adjacent to the path along which said carriage is moved, each of said ramps being located adjacent to the lever with which it is associated so as to lead upwardly therefrom, said strikers being movably mounted on said ramps and being capable of being propelled along said ramps by actuation of the levers associated with said strikers when they are located adjacent to the lowermost portions of the ramps with which they are associated, each of said structures being capable of engaging one of said lever means so as to impart movement to said carriage and being capable of moving said arm when said arm is adjacent thereto, said front surface is a transluscent surface, and said visible means is a light source.

5. A game structure which comprises:

a mounting member, a carriage movably mounted on said mounting member so as to be capable of being moved back and forth along a path, an arm pivotally mounted on said carriage so as to be capable of being pivoted between two different positions, a moving means located at each of said ends of said path for moving said carriage along said path and for moving said arm when said arm is in one of said positions, a scoring means located adjacent to each of said ends of said path for determining when a portion of said arm has moved to a specific location as the result of the operation of one or both of said moving means.

6. A game structure which comprises:

a housing having a bottom, a front surface through which an object can be viewed, and ends connected by said bottom and said front surface, a carriage movably mounted on said bottom so as to be capable of being moved back and forth along a path in back of said front surface between a first position adjacent to one of said ends and a second position adjacent to the other of said ends, visible means for simulating a member which is moved as a game is played supported on said carriage so as to move as said carriage is moved, said visible means being capable of being viewed through said front surface, and two separate moving means for moving said carriage, one of said means being mounted adjacent to one end of said housing and the other of said means being mounted adjacent to the other end of said housing, each of said moving means includes a lever, an associated ramp and an associated striker, said levers being mounted on said housing so as to be accessible from the exterior of said mounting, said ramps being located in back of said front surface adjacent to the path along which said carriage is moved, each of said ramps being located adjacent to the lever with which it is associated so as to lead upwardly therefrom, said strikers being movably mounted on said ramps and being capable of being propelled along said ramps by actuation of the levers associated with said strikers when they are located adjacent to the lowermost portions of the ramps with which they are associated, both of said strikers being capable of engaging said carriage so as to cause movement of said carriage and being capable of moving through the action of gravity to adjacent to the levers with which they are associated, each of said levers being capable of being actuated so as to exert a blow against a part of said carriage so as to cause said carriage to move.

7. A game structure which includes:

a housing having a front surface through which an object can be viewed, said front surface having opposed ends, a carriage movably mounted within said housing in back of said front surface, said carriage being located between said ends of said front surfaces and being capable of moving between different positions relative to said front surface, an arm pivotally mounted on said carriage so as to be capable of being pivoted parallel to said front surface between different positions adjacent to said ends, visible means for simulating a member which is moved as said game is played supported on said extremity of said arm remote from said carriage, said visible means being located so as to be capable of being viewed through said front surface, two separate means for controlling the movement of said arm and said carriage relative to said housing so that as said game is played the movement of said arm is controlled through the actuation of said separate means.

* * * * *

UNITED STATES PATENT OFFICE
CERTIFICATE OF CORRECTION

Patent No. 4,095,792 Dated June 20, 1978

Inventor(s) HIDEYUKI KANNO

It is certified that error appears in the above-identified patent and that said Letters Patent are hereby corrected as shown below:

Column 3, line 27, correct spelling of "pivoted".

Column 4, line 46, correct spelling of "pivoting".

Column 5, line 51, correct spelling of "pivoted".

Column 6, line 5, correct spelling of "pivoted".

Column 6, line 54, correct spelling of "pivoted".

Column 6, line 56, correct spelling of "pivoted".

Column 8, line 26, "mounting" should read --housing--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*

UNITED STATES PATENT OFFICE
CERTIFICATE OF CORRECTION

Patent No. 4,095,792 Dated June 20, 1978

Inventor(s) HIDEYUKI KANNO

It is certified that error appears in the above-identified patent and that said Letters Patent are hereby corrected as shown below:

Column 6, line 41, (Claim 1) substitute the word --arm-- for the word "carriage", first occurrence;

Column 8, line 60, (Claim 7) substitute the word --an-- for the word "said", second occurrence.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*